US008083887B2

(12) United States Patent
LaRue et al.

(10) Patent No.: US 8,083,887 B2
(45) Date of Patent: Dec. 27, 2011

(54) METHOD OF FORMING A CONTAINER HAVING AN INTERNAL RESERVOIR

(75) Inventors: Jon Michael LaRue, Lake Villa, IL (US); Craig Edward Cappel, Lake Villa, IL (US); Frank Andrew Petlak, Antioch, IL (US); Marshall Van Domelen, Conyers, GA (US)

(73) Assignee: Pactiv Corporation, Lake Forest, IL (US)

( * ) Notice: Subject to any disclaimer, the term of this patent is extended or adjusted under 35 U.S.C. 154(b) by 186 days.

(21) Appl. No.: 12/514,564

(22) PCT Filed: May 14, 2007

(86) PCT No.: PCT/US2007/068869

§ 371 (c)(1),
(2), (4) Date: Aug. 4, 2009

(87) PCT Pub. No.: WO2008/060688

PCT Pub. Date: May 22, 2008

(65) Prior Publication Data

US 2010/0212827 A1 Aug. 26, 2010

Related U.S. Application Data

(63) Continuation-in-part of application No. 11/559,653, filed as application No. PCT/US2006/044289 on Nov. 14, 2006, now Pat. No. 7,921,992.

(60) Provisional application No. 60/737,023, filed on Nov. 14, 2005.

(51) Int. Cl.
*B65D 1/34* (2006.01)

(52) U.S. Cl. ..... 156/290; 264/155; 264/156; 264/161

(58) Field of Classification Search ..... 156/290; 264/155, 156, 161
See application file for complete search history.

(56) References Cited

U.S. PATENT DOCUMENTS 2,732,696 A 1/1956 Baker
(Continued)

FOREIGN PATENT DOCUMENTS

CH 663943 1/1988
(Continued)

OTHER PUBLICATIONS

U.S. Appl. No. 11/559,653, filed Nov. 14, 2006.
(Continued)

*Primary Examiner* — Jeff Aftergut
*Assistant Examiner* — Jaeyun Lee
(74) *Attorney, Agent, or Firm* — Baker Botts L.L.P.

(57) ABSTRACT

A method of forming a container (100) includes heating two webs of material and indexing the webs into a vacuum thermoformer (40) which forms first (220) and second trays (110) simultaneously, wherein the second tray is disposed within a space of the first tray to define a reservoir (300) therebetween. A portion of the first tray is brought into contact with a flange portion of the second tray, and joined by a heat seal within the vacuum thermoformer. A punch device within the vacuum thermoformer perforates a drain aperture (117) in a central region of the bottom of the second tray, such that the drain aperture is in fluid communication with the reservoir. The cut-out section is adhered to the bottom of the first tray to eliminate the presence of any scrap material. The joined first and second tray is indexed out of the vacuum thermoformer and trimmed to separate an assembled container from the web supply.

8 Claims, 6 Drawing Sheets

U.S. PATENT DOCUMENTS

| | | | | |
|---|---|---|---|---|
| 2,814,381 | A | 11/1957 | Stevick | |
| 2,918,379 | A | 12/1959 | Lurie | |
| 3,026,209 | A | 3/1962 | Niblack et al. | |
| 3,151,799 | A | 10/1964 | Engels et al. | |
| 3,155,303 | A | 11/1964 | Fenkel | |
| 3,264,120 | A | 8/1966 | Westcott | |
| 3,288,344 | A | 11/1966 | Woollen et al. | |
| 3,420,431 | A | 1/1969 | Donovan | |
| T860,020 | I4 | 3/1969 | Anderson | |
| 3,438,507 | A | 4/1969 | Kreuger | |
| 3,563,445 | A | 2/1971 | Clayton | |
| 3,834,606 | A | 9/1974 | Andersson | |
| 3,885,728 | A | 5/1975 | Gilley | |
| 3,932,575 | A | 1/1976 | Andersson | |
| D249,238 | S | 9/1978 | Limon et al. | |
| 4,463,894 | A * | 8/1984 | Daines | 206/521.1 |
| 4,576,278 | A | 3/1986 | Laiewski et al. | |
| 4,664,922 | A | 5/1987 | Leon et al. | |
| D294,466 | S | 3/1988 | Culver | |
| 4,949,897 | A | 8/1990 | Pawlak et al. | |
| 5,266,763 | A | 11/1993 | Colombo | |
| 5,352,416 | A | 10/1994 | Wagner | |
| 5,456,379 | A | 10/1995 | Krupa et al. | |
| 5,705,213 | A | 1/1998 | Guillin | |
| 5,720,999 | A * | 2/1998 | Lanzani et al. | 426/129 |
| 6,269,946 | B1 | 8/2001 | Colombo | |
| 6,619,501 | B2 | 9/2003 | Hayes et al. | |
| 6,627,273 | B2 | 9/2003 | Wolf et al. | |
| 6,671,578 | B1 | 12/2003 | D'Amelio et al. | |
| 6,983,575 | B2 | 1/2006 | Longo | |
| 2003/0057114 | A1 | 3/2003 | Brander | |
| 2004/0211682 | A1 | 10/2004 | Brander | |
| 2005/0075409 | A1 * | 4/2005 | Harfmann | 521/79 |
| 2007/0056863 | A1 | 3/2007 | Chou | |

FOREIGN PATENT DOCUMENTS

| | | |
|---|---|---|
| DE | 42346332 | 4/1994 |
| EP | 0600535 | 6/1994 |
| EP | 0701955 | 3/1996 |
| EP | 1053944 | 11/2000 |
| FR | 2519840 | 7/1983 |
| FR | 2564807 | 11/1985 |
| FR | 2622551 | 5/1989 |
| FR | 2697809 | 5/1994 |
| FR | 2775261 | 8/1999 |
| NL | 8000159 | 8/1981 |
| WO | WO 8600275 | 1/1986 |
| WO | WO 8607036 | 12/1986 |
| WO | WO8607036 | 12/1986 |
| WO | WO 93/06026 | 4/1993 |
| WO | WO9306026 | 4/1993 |
| WO | WO 9306026 | 4/1993 |
| WO | WO 99/00314 | 1/1999 |

OTHER PUBLICATIONS

U.S. Appl. No. 11/793,066, filed Feb. 2, 2008.
U.S. Appl. No. 11/793,066, filed Sep. 21, 2009 Non-Final Rejection.
U.S. Appl. No. 11/793,066, filed Dec. 16, 2009 Response to Office Action.
U.S. Appl. No. 11/793,066, filed May 6, 2010 Notice of Allowance.
U.S. Appl. No. 11/559,653, filed Dec. 10, 2010 Notice of Allowance.
U.S. Appl. No. 11/559,653, filed Oct. 22, 2010 Response to Office Action.
U.S. Appl. No. 11/559,653, filed Jul. 22, 2010 Final Office Action.
U.S. Appl. No. 11/559,653, filed May 24, 2010 Response to Office Action.
U.S. Appl. No. 11/559,653, filed Dec. 24, 2009 Non-Final Office Action.
U.S. Appl. No. 11/559,653, filed Nov. 12, 2009 Response to Office Action.
U.S. Appl. No. 11/559,653, filed Aug. 14, 2009 Final Office Action.
U.S. Appl. No. 11/559,653, filed May 4, 2009 Response to Office Action.
U.S. Appl. No. 11/559,653, filed Feb. 3, 2009 Non-Final Office Action.
U.S. Appl. No. 11/559,653, filed Dec. 8, 2008 Response to Restriction.
U.S. Appl. No. 11/559,653, filed Nov. 7, 2008 Restriction Requirement.
U.S. Appl. No. 11/793,066, filed Jun. 15, 2007.
U.S. Appl. No. 11/793,066, Non-final rejection-Sep. 21, 2009.
U.S. Appl. No. 11/559,653, Non-final rejection-Feb. 3, 2009.
U.S. Appl. No. 11/559,653, Office Action response-May 4, 2009.
U.S. Appl. No. 11/559,653, Final rejection-Aug. 14, 2009.

* cited by examiner

METHOD OF FORMING A CONTAINER HAVING AN INTERNAL RESERVOIR

CROSS REFERENCE TO RELATED APPLICATIONS

This application is a National Phase of International Application PCT/US07/068869, filed May 14, 2007, which is a Continuation-in-Part of U.S. Nonprovisional application Ser. No. 11/559,653 filed Nov. 14, 2006, now U.S. Pat. No. 7,921,992 issued Apr. 12, 2011 and International Application No. PCT/US06/044289 filed Nov. 14, 2006, which claim the benefit of U.S. Provisional Application Ser. No. 60/737,023, filed Nov. 14, 2005, each of which are herein incorporated by reference in their entirety.

BACKGROUND OF THE INVENTION

1. Field of the Invention

The present invention relates to a container for packaging. Particularly, the present invention is directed to a method of forming a container for packaging products or other items susceptible to exuding liquids, wherein the container has an internal reservoir for the collection of liquids exuded therefrom.

2. Description of Related Art

Conventional containers for packaging and display of meat, produce and other products for consumers are made of plastic foam or paperboard, and generally are simple concave trays having a separate transparent film cover or overwrap.

Consumers prefer to purchase items such as meat, poultry, seafood and products that release liquid, in dry packages. However, the amount of liquid residing in a food container typically increases over time, as the product ages and exudes liquid. Accordingly, retailers frequently rewrap the package, reduce the sale price of the product, or remove the product from the shelf because of consumer perception that the product might be spoiled. Moreover, such liquid can leak from a package if the package is not well sealed.

A common practice to reduce the problems caused by exuded liquids inside such containers includes the use of an absorbent pad, which is placed in or glued to the bottom of the container, typically between the container and the contents of the package. Typically, this practice requires a separate supply line in the manufacturing process for delivering the absorbent pad to the container, an additional step in the manufacturing process for application of the adhesive, and a dwell period to allow the adhesive to firmly bond the absorbent pad to the container. Further, the particular composition of absorbent pad and adhesive must comply with Federal Drug Administration guidelines and regulations regarding materials in direct contact with edible products.

Such conventional methods of forming containers having absorbent pads generally have been considered satisfactory for their intended purpose. For example, U.S. Pat. Nos. 3,834,606 and 6,695,138, which are hereby incorporated by reference in their entirety, disclose various absorbent pad configurations and methods of manufacture. However, these configurations are subject to a variety of disadvantages including a complex, cost prohibitive process in which the resulting products may have limited absorbency. In particular, these pads can tear or stick to the container contents and freeze to the contents when frozen, all of which pose inconvenience to the consumer, and added cost. Further, absorbent pads may dry the product with which they are in contact by wicking more liquid from the product than would otherwise occur naturally. Also, liquid held by an absorbent pad can be squeezed out if the pad is pressed, which may occur as a result of handling or due to the force exerted by the film overwrap. Such pads also tend to leak fluid when products are merchandised on their side. Moreover, the manufacturing process is labor intensive and requires a separate processing line to make and insert the pads into the containers, fabricating an assortment of pad sizes for use in varying tray sizes, and additional quality inspection is required to ensure proper placement of the pads.

A self-absorbing tray using an open cell foam structure is another conventional solution to absorb excess fluids. The material becomes absorbent when holes are pierced through the surface of the tray. While effective in reducing labor required to insert pads, an open cell tray structure is weaker overall, thereby increasing the chance for folded, cracked or broken trays during wrapping and transport of the product. Depending on the tray design, open cell trays can wick moisture through the tray and transfer liquid to the consumer's hands. Some open cell foam trays change color when saturated with fluid and are therefore unsightly to consumers. Furthermore, open cell trays offer a limited amount of absorbency. Trays loaded with large amounts of meat can easily overwhelm the absorbent capacity of the tray, resulting in unabsorbed liquid pooling at the bottom of the package.

Conventional double-walled trays, which contain an absorbent pad between an outer and inner tray are expensive and also have a limited absorbency. Moisture is introduced to the absorbent core through holes in the inner tray. Like that of the open cell tray, the liquid within the pad may have a propensity to be wicked up to and leaked from top edges of these types of trays. Further, the process used to manufacture these trays results in a rough edge that tends to pierce film wraps, which also results in leakage of liquid from the container.

Packaging containing an absorbent pad, either glued inside or sandwiched between inner and outer trays, creates a packaging container comprised of many different materials. The added labor and expense required to remove the absorbent materials from the package prohibit recycling of such packaging.

As evident from the related art, conventional methods often require excessive manufacturing cost and complexity while providing a container which suffers from inadequate absorbency of exuded liquids.

There thus remains a need for an efficient and economic method of manufacturing a container capable of containment of exuded liquids from and pooling of exuded liquids within container for packaging liquid-exuding products, such as meats, produce and other products.

SUMMARY OF THE INVENTION

The purpose and advantages of the present invention will be set forth in and apparent from the description that follows, as well as will be learned by practice of the invention. Additional advantages of the invention will be realized and attained by the methods and systems particularly pointed out in the written description and claims hereof, as well as from the appended drawings.

An object of the invention is to provide a packaging tray for products that tend to release liquids that avoid the drawbacks of existing trays set forth above. To achieve these and other advantages and in accordance with the purpose of the invention, as embodied and broadly described, the invention includes a method of manufacturing a packaging container including first and second trays.

In one aspect of the invention, the method includes providing a first web of material and a second web of material, and heating each of the first and second webs to facilitate the forming of the webs into a particular container shape, as desired. In one embodiment, the first web is formed into a first tray having a shape which includes a first bottom wall, and a surrounding first sidewall extending generally upwardly from the first bottom wall to define a space therein. Similarly, the second web is formed into a second tray having a shape which preferably includes a second bottom wall and a surrounding second sidewall extending generally upwardly from the second bottom wall to define a space therein. The second tray is sized such that it can be positioned within the space defined by the first tray such that the second bottom of the second tray is spaced from the first bottom of the first tray to define a reservoir therebetween. Further, the first and second trays are joined to one another about at least a portion of the perimeter, the joined first and second tray defining a product receiving unit for receiving a food product.

In accordance with another aspect of the invention, the method of forming the container includes a dwell period to cool the first and second trays to a desired temperature, wherein at least one drain aperture is formed in the second tray, the at least one drain aperture in fluid communication with the reservoir. The central drain region is proximate to the center, or a centerline of first bottom the second tray, depending on the specific embodiment. Also, the second bottom of the second tray can be formed with a downward slope towards the drain aperture(s) to facilitate the draining of exuded liquid into the reservoir.

In accordance with still another aspect of the invention, the first and second webs are unwound from separate rolls of stock material, which can be of either homogenous or dissimilar material compositions, and formed into the desired tray shape via vacuum or pressure thermoformer. The thermoformer can be configured to form the first and second tray simultaneously, as well as form a plurality of first and second trays simultaneously, if so desired. In one arrangement, the thermoformer includes an upper tool which is configured to impart the desired geometry of the second tray into the second web, and a lower tool which is configured to impart the desired geometry of the first tray into the first web. Additionally, the steps of forming the first and second trays, joining the first and second trays, and forming the at least one drain aperture in the second tray can be performed in a single thermoformer.

The joining of the first and second trays can be achieved by a conductive coil or heating element, disposed within either the upper or lower tool of the thermoformer, which forms a heat seal that extends around at least a portion of the perimeter of the first and second trays. In some embodiments, the heating element is employed at sufficient temperature and duration that a portion of sidewalls of the first and second tray are joined together. Additionally, the first bottom of the first tray may be formed to include at least one raised surface feature, to which the second bottom of the second tray can be joined. The joined first and second trays, which in an assembled arrangement define the product receiving unit, are separated or trimmed from the first and second webs, respectively.

In another aspect of the invention, the temporal order of the heating, forming, joining, forming of the drain aperture, and trimming can be performed in any sequence, as desired.

In accordance with another aspect of the invention, a container is formed by providing pre-formed first and second trays, wherein the first tray has a bottom wall and a surrounding sidewall extending generally upwardly from the bottom wall to define a space therein. The second tray is configured to be received within the space of the first tray, such that the second tray is spaced from the bottom of the first tray to define a reservoir therebetween. The first and second trays are joined to each other along at least a portion of the perimeter of the second tray. The drain aperture(s) is formed by perforating at least one section of the second tray to define at least one drain aperture in fluid communication with the reservoir, with at least a portion of the perforated section being joined to the first tray. In one embodiment, the perforation of the drain aperture(s) is performed via a punch device. The punch device can include a conduit for introducing air through the drain aperture(s) to displace the second tray relative to the bottom of the first tray. Preferably, the perforated section(s) is welded to the bottom of the first tray.

It is to be understood that both the foregoing general description and the following detailed description are exemplary and are intended to provide further explanation of the invention claimed.

The accompanying drawing, which is incorporated in and constitutes part of this specification, is included to illustrate and provide a further understanding of the method and system of the invention. Together with the description, the drawing serves to explain the principles of the invention.

BRIEF DESCRIPTION OF THE DRAWINGS

FIG. 1-B is a bottom-perspective view of a first embodiment of a container having an internal reservoir, in accordance with the invention.

FIG. 1-C is a cross-sectional view of a first embodiment of a container having an internal reservoir, in accordance with the invention.

FIG. 1-D is a cross-sectional view of a first embodiment of a container having an internal reservoir, in accordance with the invention.

FIG. 1-E is a top-perspective view of a first embodiment of a container having an internal reservoir, in accordance with the invention.

FIG. 2-B is a cross-sectional view of a second embodiment of a container having an internal reservoir, in accordance with the invention.

FIG. 2-C is a cross-sectional view of a second embodiment of a container having an internal reservoir, in accordance with the invention.

FIG. 2-D is a perspective view of a second embodiment of a container having an internal reservoir, in accordance with the invention.

DETAILED DESCRIPTION OF THE PREFERRED EMBODIMENT

Figures 1A, 1B, 1C:
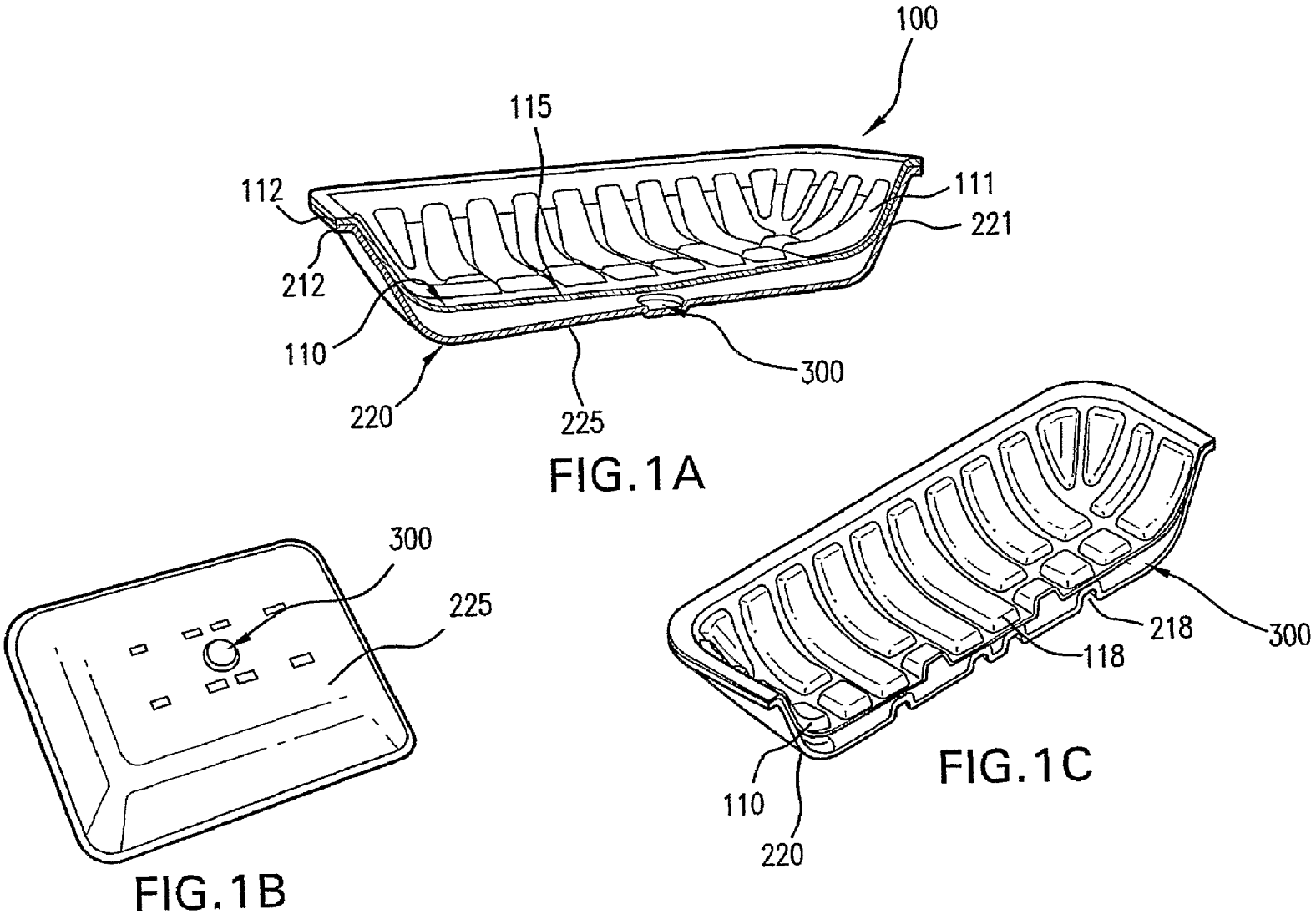
FIG. 1-A is a cross-sectional view of a first embodiment of a container having an internal reservoir, in accordance with the invention.
Figure 1E:
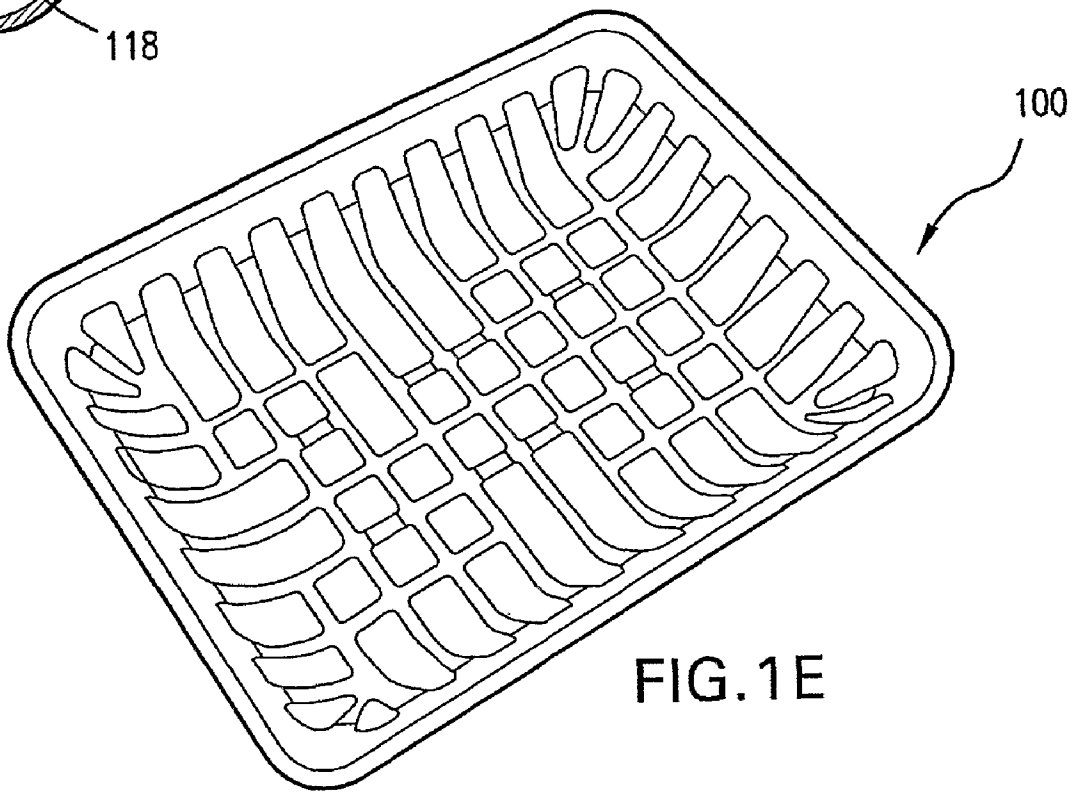
Figure 1D:
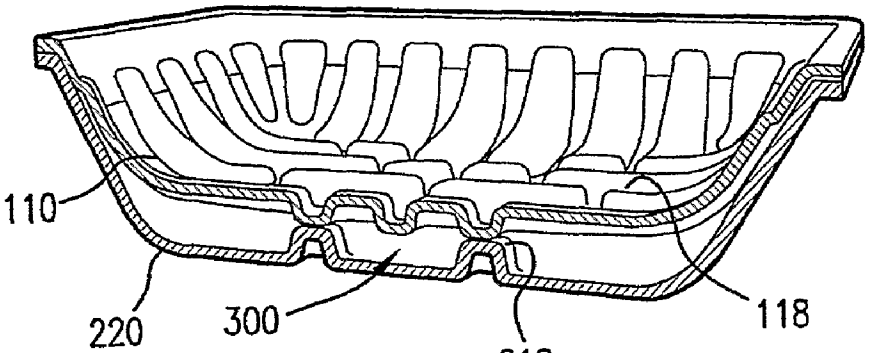
Figure 2C:
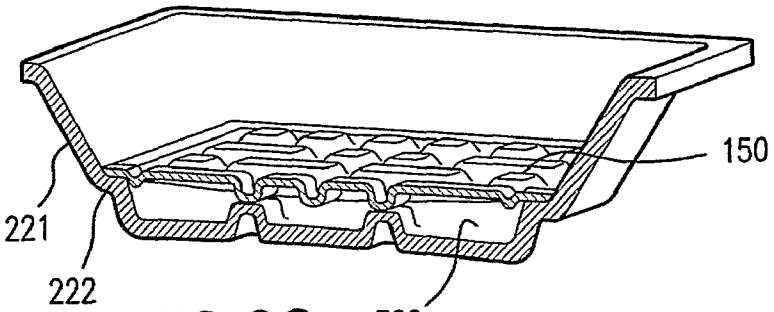
FIG. 2-A is a top view of a second embodiment of a container having an internal reservoir, in accordance with the invention.
Figure 2D:
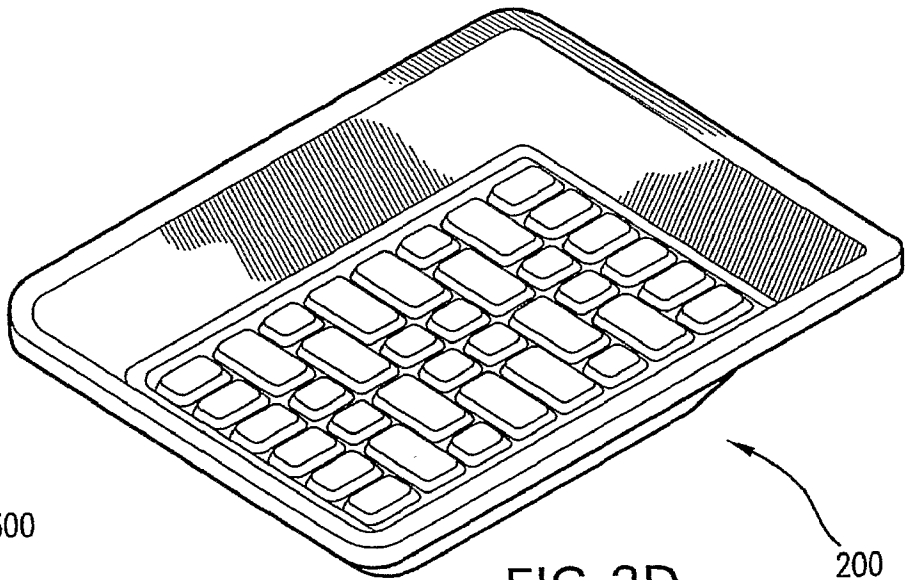
Figure 2A:
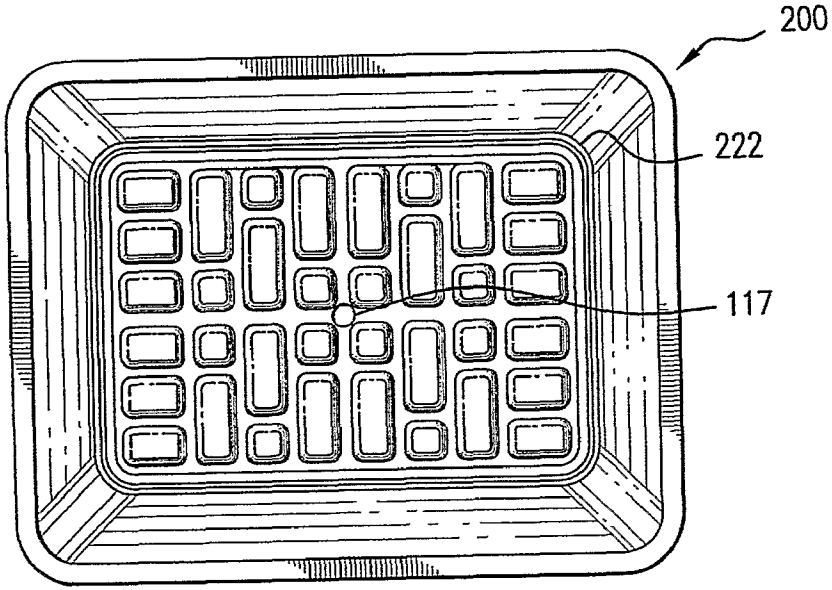
Figure 2B:
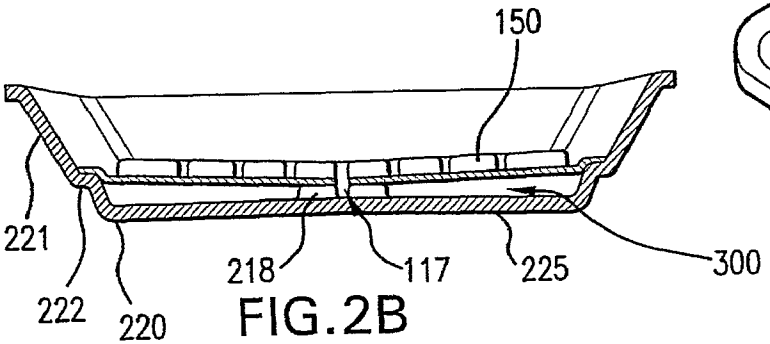

Reference will now be made in detail to the present preferred embodiments of the invention, an example of which is illustrated in the accompanying drawing. The method and corresponding steps of the invention will be described in conjunction with the detailed description of the system.

The apparatus and related methods presented herein can be used for packaging of any product, particularly a liquid-exuding product. The present invention is particularly suited for the packaging of meat, produce, and other perishable products. In accordance with the invention, a container is formed comprising first and second trays. The various geometries and structural features of the first and second tray are disclosed in detail in copending U.S. Nonprovisional patent application Ser. No. 11/559,653 filed Nov. 14, 2006, and U.S. Provisional Application No. 60/737,023 filed Nov. 14, 2005, which are herein incorporated by reference in its entirety.

FIGS. 1A-1E illustrate an example of the product produced by the inventive method described in detail below. FIGS. 1A-1E, illustrate a container 100 which generally includes a first tray 220 and a second tray 110. The first or "bottom" tray 220 is preferably larger than the second tray 110, having a sidewall 221 and a bottom wall 225 defining a recessed space. The space is preferably large enough to accommodate at least a portion of the second tray 110, if not essentially the entire second tray 110.

The second or "top" tray 110 includes a bottom wall 115 which rests on or nests within the first tray 220 as shown in FIG. 1A. As embodied herein, a sidewall 111 preferably extends from the bottom wall 115. An outer edge 112 of the second tray 110 rests on and, preferably, is attached to an outer edge 212 of the first tray 220. Sidewall 111 of the second tray 110 connects the edge region 112 to the bottom wall 113 of the second tray 110. In a preferred embodiment, a flange is provided at the edge of at least one of the edge regions 112, 212. Attachment of the two trays is preferably effected by any suitable method, and preferably, a watertight connection is formed, such as by heat welding or adhesive, cohesive, ultrasonic welding or chemical bonding techniques as discussed below.

Figure 3:
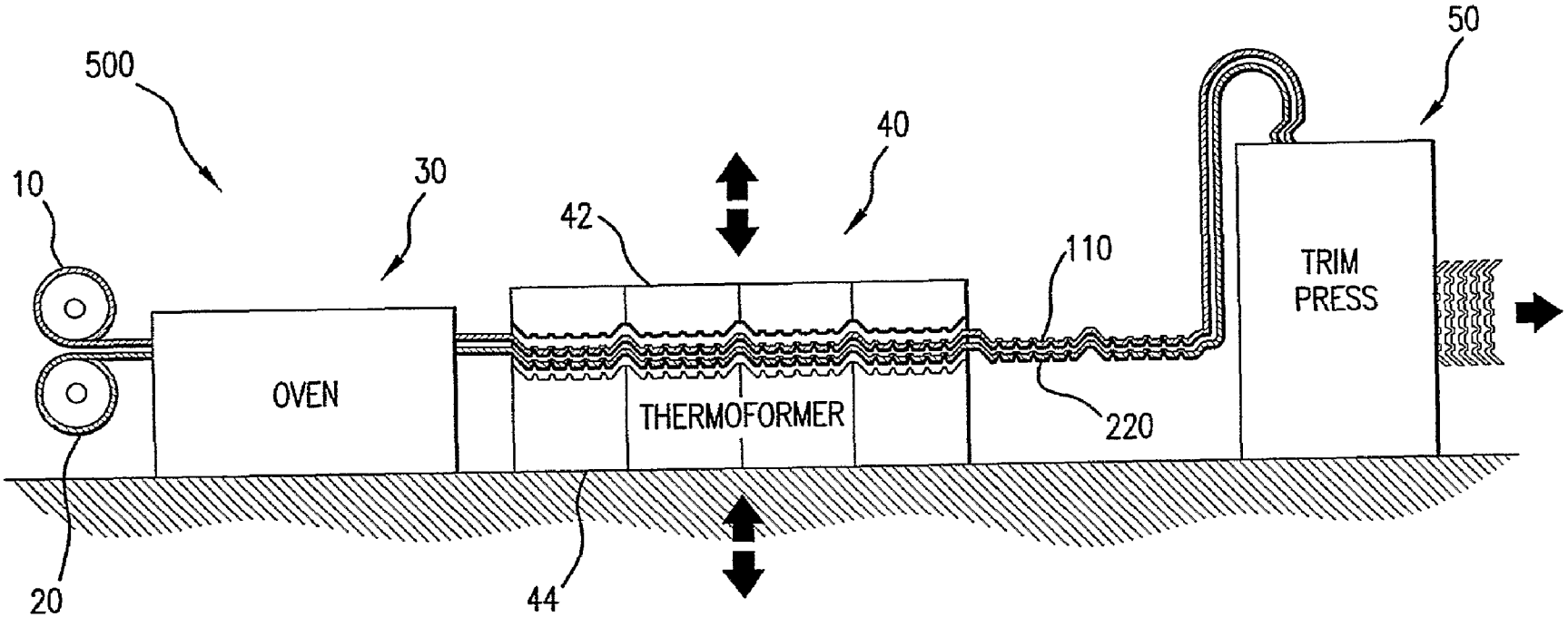
FIG. 3 is a schematic representation of the method of manufacturing a container having an internal reservoir in accordance with the invention.

For purpose of explanation and illustration, and not limitation, an exemplary embodiment of the method in accordance with the invention is shown in FIG. 3 and is designated generally by reference character 500.

As shown in FIG. 3, the system 50 generally includes providing a first web of material (20) and a second web of material (10) from separate stock, or alternatively providing a single supply of stock material which is then converted into first and second webs. Typically, the first and second webs are delivered from separate stock rolls by simultaneously unwinding the rolls at equal rate of speed. The first and second webs each or both can be of homogenous or dissimilar material compositions, and include indicia such as differing colors for various aesthetic configurations or marketing purposes, among other things. As embodied herein, the first and second webs are heated, such as in an oven (30) or equivalent device which preferably provides heat from both above and below at least one of the webs, to facilitate the shaping of the webs into the desired container geometry as well as assisting the joining of the webs, as will be discussed in detail below.

The first and second webs are delivered to a tray forming station (40), which in a particular embodiment is a vacuum or positive pressure thermoformer, though various molds and other devices suitable for imparting the desired tray geometries to the webs are contemplated to be within the scope of this invention. As embodied herein, the first and second webs preferably are formed into first and second trays, respectively. The former can be configured to form the first (220) and second (110) tray simultaneously, and can further be configured to form a plurality of first and second trays concurrently, if so desired. In one arrangement, the thermoformer includes an upper tool (42) configured to impart the desired geometry of the upper surface of the second tray (110) into the second web (10), and a lower tool (44) which is configured to impart the desired geometry of the lower surface of the first tray (220) into the first web (20). Alternatively, the inverse arrangement can be performed in which the upper tool imparts the geometry of the first tray into the first web while the lower tool imparts the geometry of the second tray into the second web.

In accordance with one embodied herein, the first and second webs are vertically aligned and indexed into the thermoformer (40) such that the first and second webs are disposed between the upper (42) tool and lower tool (44). A vacuum force is applied through channels in the upper and lower tool to bring the webs (10, 20) into contact with the upper and lower tools, respectively. Preferably, the upper and lower tools also bring portions of the first and second webs, which can be formed into flanges or ledges of one or both trays, into contact with each other. The vacuum force applied via the upper and lower tool bring each web into conformance with the respective tool geometry. Additionally, a positive pressure can be introduced into the space between the first and second webs, to further urge the webs against the respective tools and enhance formation of the first and second trays, respectively. The upper and lower tools can be moved toward each other and converge to apply a compressive force which facilitates the formation of the flanges, as well as creation of the seal between the two trays as discussed in further detail below.

In one embodiment, as illustrated in FIGS. 1A-1E, the first web is formed into a first tray having a shape which includes a first bottom wall, and a surrounding first sidewall extending generally upwardly from the first bottom wall to define a space therein. Similarly, the second web is formed into a second tray having a shape which includes a second bottom wall. Preferably, the second tray also includes a surrounding second sidewall extending generally upwardly from the second bottom wall to define a space therein. The second tray is sized and shaped such that at least a portion of the second tray can be positioned within the space defined by the first tray such that the second bottom of the second tray is spaced from the first bottom of the first tray to define a reservoir (300) therebetween. Preferably, the reservoir (300) is sized to contain approximately 100 grams of exuded liquid.

It is further contemplated that one or more raised surface features (118, 218) such as ribs or protrusions can be formed on the bottoms of one or both trays. For example, the first tray can be provided with raised surface features to contact with the second bottom of the second tray. Such raised surface features are advantageous for enhancing the structural integrity of the overall container, and if joined to the second bottom of the second tray as illustrated, can ensure the size of the reservoir, i.e. the space (300) between the first bottom of the first tray and the second bottom of the second tray, generally remains constant. The raised surface features can be formed in a variety of desired quantity or pattern. Preferably, the surface features are configured to aide the flow of exuded liquid to the aperture, and into the reservoir. The surface features, furthermore, support the product to be packaged above the upper surface of the bottom wall of the second tray to minimize contact with the exuded liquid and prevent the contents from occluding the drain aperture.

Further, the first and second trays are joined to one another about at least a portion of the perimeter, the joined first and second tray defining a product receiving container for receiving a food product. Numerous suitable techniques may be employed for joining the trays depending upon the material selected for each tray, such as adhesive, cohesive, lip rolling, mechanical crimping, ultrasonic welding, vibration welding, chemical bonding, mechanical snap fitting and induction welding, or combinations thereof can also be used to join the first and second trays. Other known types of bonding techniques can be used, as can mechanical interlocking or interference fit techniques for joining the two trays.

Generally, for use with certain thermoplastic materials, heat sealing is preferred for the resulting strength, cost, and performance. Heat sealing also allows for scrap portions of the webs remaining after the trimming operation to be reclaimed to provide material and cost savings.

In a preferred embodiment, a thermally conductive ring is provided in at least one of, and preferably both of, the upper and lower tools of the thermoformer. Each ring generates sufficient heat to form a heat seal about the perimeter of the first and second trays disposed within the flange portion of the trays. More preferably, the position of the rings in the upper and lower tools can be adjustable in a vertical direction to allow for the modification to the clamp force provided by the upper and lower tools. This is advantageous in that the variable positioning of the rings provides a selective and sufficient force to attain a leak free seal between the first and second trays if desired. In order to reduce process cycle duration, the heating elements preferably are continuously activated, however the intermittent operation of the rings is also possible, if desired. Preferably, the heating element may be activated to a predetermined temperature, for example for use with webs having a thickness in the range of approximately 40~90 mm, to a temperature of approximately 220° F. or higher, and for a sufficient duration, for example approximately 3.75 seconds, to form a heat seal which can extend beyond the flange portion of the trays and downwardly a desired distance of approximately 1 inch along adjacent sidewalls of the trays as shown in FIG. 1-D. More preferably, the heating element on the lower tool extends toward the upper tool, whereas the corresponding surface of the upper tool is flush, such that upper surface of the second tray is not embossed or otherwise altered. The presence of such an elongated seal can reinforce the sidewalls and enhance the crush strength of the assembled container, while further preventing the tendency for bowing as a result of the application of a shrink wrap around the container.

Figure 4:
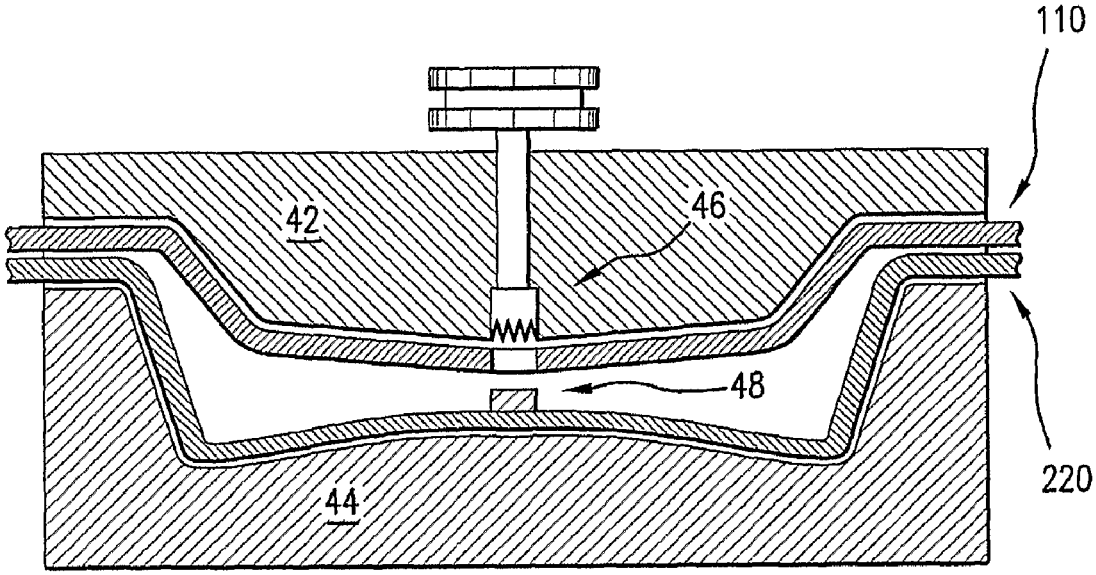
FIG. 4 is a cross-sectional side view illustrating the forming of the drain aperture(s).
Figure 5A:
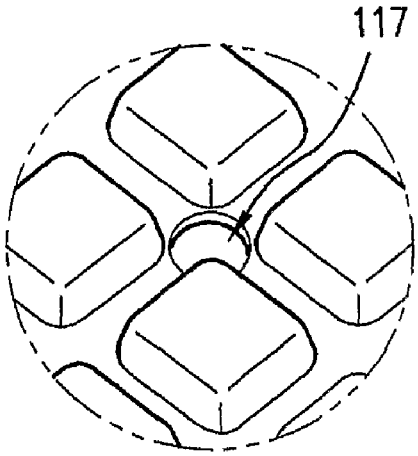
FIG. 5A-D is an enlarged view of various drain aperture configurations for the container of FIGS. 1A-E.
Figure 5B:
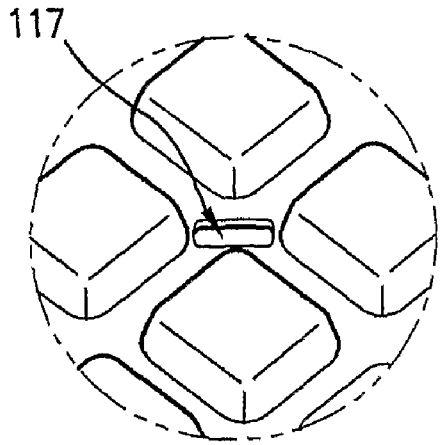
Figure 5C:
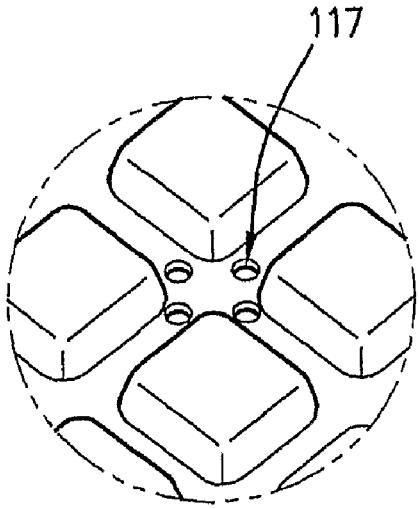
Figure 5D:
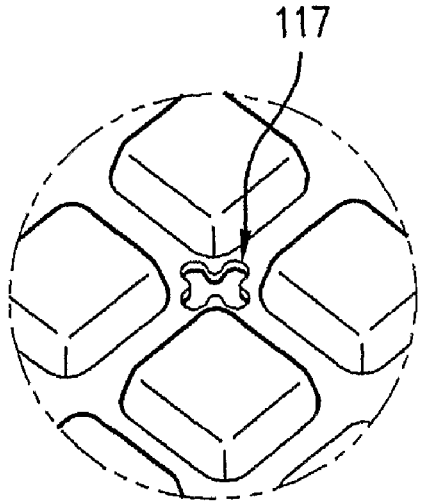

According to another aspect of the invention illustrated in FIG. 4, the upper tool (42) of the thermoformer is equipped with a device for forming at least one drain aperture (117) in the second tray. If desired, or necessary, depending on the contents of the container, a plurality of apertures can be provided in a central region of the second bottom as shown in FIGS. 5A-D. Additionally or alternatively, apertures can be provided along the edge of the second bottom of the second tray (110). Typically, the first and second webs are formed into the first and second trays while the webs are at an elevated temperature as discussed above. A cooling, or dwell period allows for the temperature of the formed trays to decrease to a desired temperature, which is above ambient temperature. The drain aperture(s) preferably are formed at this above-ambient temperature.

In one embodiment, the upper tool includes a punch mechanism (46) which perforates the second bottom of the second tray (110) to cut out at least one section, or slug (48), which defines the drain aperture(s). The cut-out (48) section is preferably is urged toward and adheres to the first bottom of the first tray (220) by the latent heat remaining after the heating of the trays discussed above. This process is advantageous in that it avoids the need to discard or otherwise secure a cut-out that is entirely severed from the second tray. Preferably, the punch mechanism includes a pneumatic port for introducing positive pressure between the first and second webs during the forming process to further urge the webs against the lower and upper tools, respectively.

As FIG. 3 illustrates the simultaneous forming of a plurality of containers, with each container including a first and second tray, the upper tool of the thermoformer can be equipped with a plurality of punch mechanisms, i.e. one punch mechanism for forming at least one drain aperture in the upper tray for each corresponding container. In this embodiment, the punch mechanisms can be operated independently of each other, or alternatively the plurality of punch mechanisms can be driven simultaneously by a common operator. The operator for driving the punch mechanism(s) is preferably an air cylinder, however a servo motor or other electro-mechanical device can actuate the punch mechanism(s).

In the alternative, or in addition to forming the drain aperture(s) via the punch mechanism forming a slug as described above, the drain aperture(s) (117) can be formed by melting or other high temperature process for forming a hole in the second tray. For example, this can be accomplished by heating a probe in the upper tool of the thermoformer, either continuously or intermittently, to a temperature of approximately 650° F. and advancing the probe into the second tray. This high temperature technique has the advantage of not forming any scrap or slug portions, and therefore eliminates the need for any associated scrap removal steps and/or equipment. Additionally and/or alternatively, a finishing punch can be used to form the final desired shape and dimensions for the aperture(s) after the first and second trays have been formed, joined and cooled.

Generally, and as illustrated in FIGS. 5A-5D, the size of the apertures will depend upon the intended tray size and food product. It is preferable, however, to use an appropriate size that is sufficiently large to allow drainage of liquid into the reservoir and venting of gases out of the reservoir without the need for a separate vent hole, but sufficiently small to prevent spillage of the liquid from the reservoir. The preferred aperture size therefore will depend upon the number of apertures provided, whether venting is required or provided by an alternative vent opening, the characteristics of the fluid (e.g., viscosity, surface tension), and the expected flow rate, among other factors. For example, a single round hole with a diameter of about 0.375 inches is suitable for both drainage of liquid and venting of air for a conventional meat product container.

By providing a plurality of apertures, a smaller aperture size can be used to accommodate the same flow rate as a single aperture of larger size. The total amount of aperture area can be calculated by summing the entire area of each individual aperture. In this manner, providing a plurality of smaller apertures over a large area can reduce the risk of spillage as well as reduce any compromise to the integrity of the bottom wall of the second or "upper" tray.

By contrast, however, it is beneficial to ensure adequate aperture area to accommodate the required functionality. While, for the foregoing reasons, a smaller aperture can be desirable, there are additional considerations to be made when reducing the size of the aperture. Firstly, for very small apertures, the surface tension of the liquid can provide a substantial obstacle to proper drainage. For these and even larger holes, if the aperture is not large enough to allow air from the reservoir to escape while liquid enters, then drainage will also be impeded.

Additionally or alternatively, the aperture(s) can be formed such that at least a portion of the material which is punched to form the aperture(s) remains attached to the second tray. For example and in accordance with one embodiment, the entire boundary of the cut-out (48) is not separated from the second tray. Instead, the punch is configured to sever a cut-out along an edge defining the aperture(s) that extends a distance less than the entire perimeter of the aperture(s). Accordingly, a portion of the cut-out remains connected to the remainder of the second tray. The cut-out can be depressed downwards and adhered to the first tray to allow liquid to flow into the internal reservoir.

To aid in the bonding of the cut-out to the second tray, as well as the spacing of the first bottom of the first tray from the second bottom of the second tray, the punch device can be configured with an internal conduit for channeling air into the reservoir. A blast of heated air can be delivered via the conduit through the aperture(s) to facilitate the separation of the bottoms of the first and second trays and further assist the shaping of the trays in the thermoformer, as discussed above.

The upper (42) and lower (44) tools of the thermoformer (40) diverge to release the assembled container and allow for the first and second webs to be indexed to the trimming station (50). In one embodiment, the trim station (50) is a separate station. Alternatively, and in accordance with another preferred embodiment, a trim-in-place device can be employed in which the trimming operation is performed in the same station as used for forming of the trays, joining of the trays, and formation of the drain aperture(s). For example, a trim press can operate along the flange portion to sever each assembled container from the webs and thereby define a product container unit. The trim press can operate to sever one assembled container at a time, or alternatively a plurality of assembled containers simultaneously, if so desired. A plurality of severed containers can be stacked to reduce storage space and advanced to further product handling and shipping processes. Suitable equipment for such forming, joining and trimming processes are available from Irwin Research and Development, Inc. and can be modified accordingly as desired.

The particular order of operations described above is for purposes of explanation and illustration only, and not limitation. Indeed, the steps of heating the webs, forming the webs into trays, joining the first and second trays, forming a drain aperture, and trimming the assembled container from the web supply can be performed in a variety of desired temporal sequences. Further, while the preferred embodiment performs the steps of forming first and second webs into first and second trays, joining of the trays, and forming the drain aperture in a single thermoformer, it is contemplated that one or more of these operations can be performed separately and independently of each other—although it is preferred that certain steps be performed simultaneously.

As detailed above, one preferred sequence for manufacturing the container includes: i) heating of the first and second webs; ii) forming first and second trays from the first and second webs, respectively; iii) joining the first and second trays; iv) punching a drain aperture(s); and v) trimming the assembled container from the web. Preferably, forming, joining and punching are performed simultaneously. Alternatively, the method for manufacturing the container can be performed in the following sequence: i) heating the first and second webs; ii) forming first and second trays from the first and second webs, respectively; iii) joining the first and second trays; iv) trimming the assembled container from the web; and v) punching a drain aperture(s). Preferably, at least forming and joining are performed simultaneously, and trimming and punching are formed simultaneously. Alternatively, the punching of the drain aperture(s) can be performed in a station or apparatus which is separate and independent from the thermoformer, and/or trim press station. Particularly, at least forming of the first and second trays and joining of the first and second trays can be performed as a single integral step.

A representative example of a method of forming a tray is set forth below for purpose of illustration and not limitation. A first web of polymeric material and approximately 40 mm thickness is provided and heated to approximately 220 degrees Fahrenheit. A second web of polymeric material and approximately 90 mm thickness is provided and heated to 220 degrees Fahrenheit. The first and second webs are directed into a modified Irwin Magnum model thermoforming system with an upper tool and a lower tool. A negative approximate-vacuum pressure is applied to draw each web against the corresponding tool for a dwell time of approximately 1 second, and a positive pressure of approximately 5 lbs. can be applied between the first and second webs to further enhance the thermoforming process. The upper and lower tools converge to apply a compressive force along heating elements heated to a temperature of about 220 degrees Fahrenheit for a period of approximately 3.75 seconds. The joined webs are then cooled to a desired temperature and trimmed of excess material form the perimeter.

In another embodiment of the invention, illustrated in FIGS. 2A-2D, the method of forming the container (200) includes forming a tray having (220) a bottom wall (225) and a surrounding sidewall (221) extending generally upwardly from the bottom wall to define a space therein. Rather than form the second tray in conjunction with the first tray, a separate insert member (150) can be formed and/or provided from an independent manufacturing line. For example, the insert member (150) can be a thermoformed sheet having an alternative contoured configuration, or can be a film or panel having a substantially flat or planar shape. Preferably, at least one drain aperture (117) is formed in the insert member as previously described. The insert member is inserted into the space of the first tray, so as to be spaced from the bottom of the first tray to define a reservoir (300) with the drain aperture(s) (117) in fluid communication with the reservoir. At least a portion of the perimeter of the insert member is joined to the first tray by adhesive, cohesive, heat welding, ultrasonic welding or chemical bonding techniques or other suitable techniques. The first tray and insert member can be formed from similar or dissimilar material compositions, and further have differing aesthetic designs, e.g. color.

A raised surface feature can be formed on the bottom of the first tray, and/or on the second tray or insert member, in any of the shapes or configurations as described above. Additionally, a ledge (222) which protrudes inwardly towards the space of the first tray can be formed in the surrounding sidewall of the first tray. The second tray or insert member can be disposed within the space of the first tray on top of the raised surface feature(s) and/or protruding shelf (222).

Preferably, the second tray or insert member is provided with a downward slope towards the drain aperture(s) to facilitate the draining of exuded liquid into the underlying reservoir. This sloped geometry can be provided by employing a relatively rigid member of shape memory material in which the desired geometry is imparted directly into the second tray or insert member during the manufacture of the insert member. Alternatively, a flexible insert member can be utilized in which the weight of the food product deflects the second tray or insert member downward to provide the desired slope. Further, raised surface features can be provided on the bottom of the first tray such that the height of the surface features decreases towards the center of the first tray. The second tray or insert member can be adhered to these raised surface features of the underlying tray so as to create the desired slope.

The containers described herein can be manufactured from any suitable material, for example, expanded polystyrene foam, metal foil, such as aluminum foil, oriented polystyrene (OPS), polypropylene, mineral filled polypropylene, amorphous polyethylene terephthalate (APET), thermoplastics. It is to be understood that the foregoing list is not exhaustive, and that the containers can be made from other materials. The use of foams in forming of the trays and/or insert member requires less material and thus provides a cost benefit over sheet materials.

The containers described herein can be of any shape desired, such as, for example, circular, rectangular, oblong, oval, or square. The containers can be used for packaging uncooked foods, but can also be used for cooking and/or holding of cooked food, such as a cooked chicken. Advantageously, the subject containers are capable of retaining the liquid exuded during and after cooking of a roast chicken, for example. If used for cooking, the materials used for the container must be capable of satisfactorily withstanding oven temperatures.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents.

What is claimed is:

1. A method of forming a drain aperture comprising:

providing a first tray having a bottom wall and a surrounding sidewall extending generally upwardly from the bottom wall to define a space therein;

providing a second tray, the second tray received within the space of the first tray, the second tray spaced from the bottom of the first tray to define a reservoir;

joining at least a portion of the first tray to at least a portion of the second tray;

perforating at least one section of the second tray to define at least one drain aperture in fluid communication with the reservoir;

joining at least a portion of the perforated section to the first tray.

2. The method of claim 1, wherein the perforation of the at least one drain aperture is performed via a punch device.

3. The method of claim 2, further comprising introducing air through the at least one drain aperture to displace the second tray relative to the bottom of the first tray.

4. The method of claim 3, wherein the air is introduced through a portion of the punch device.

5. The method of claim 1, wherein the at least one perforated section is welded to the bottom of the first tray.

6. The method of claim 1, wherein the perforated section is entirely severed from the second tray.

7. The method of claim 1, wherein another of the perforated section remains attached to the second tray.

8. The method of claim 7, wherein the at least a portion of the perforated section is depressed toward and adhered to the first tray.

* * * * *